US006612362B2

(12) United States Patent
Bollig

(10) Patent No.: US 6,612,362 B2
(45) Date of Patent: Sep. 2, 2003

(54) THIN-STRIP CASTING DEVICE

(76) Inventor: Georg Bollig, Roonstrasse 8, D-47799 Krefeld (DE)

( * ) Notice: Subject to any disclaimer, the term of this patent is extended or adjusted under 35 U.S.C. 154(b) by 0 days.

(21) Appl. No.: 10/010,528

(22) Filed: Dec. 7, 2001

(65) Prior Publication Data

US 2002/0079081 A1 Jun. 27, 2002

(30) Foreign Application Priority Data

Dec. 12, 2000 (DE) ..... 100 61 882

(51) Int. Cl.[7] ..... B22D 11/06
(52) U.S. Cl. ..... 164/428; 164/480
(58) Field of Search ..... 164/428, 480

(56) References Cited

U.S. PATENT DOCUMENTS

| | | | | | |
|---|---|---|---|---|---|
| 4,498,519 | A | * | 2/1985 | Watanabe et al. | 164/417 |
| 4,702,300 | A | * | 10/1987 | Nakanori et al. | 164/155.4 |
| 4,986,339 | A | * | 1/1991 | Miyazawa | 164/466 |
| 5,954,117 | A | * | 9/1999 | Godinho | 164/472 |
| 6,257,315 | B1 | * | 7/2001 | Spink | 164/480 |
| 6,397,924 | B1 | * | 6/2002 | Fish et al. | 164/480 |
| 6,474,402 | B1 | * | 11/2002 | Sauer et al. | 164/428 |

OTHER PUBLICATIONS

"Stand des Bandgiessens von Stahl", Jun. 7, 1999, Stahl und Eisen 119, pp. 129–131.

"KTN baut die erste industriell betriebene Bandgiessanlage Europas", Jun. 1999, Stahl und Eisen 119, 1999, Nr. 6, pp. 8–10.

"Endabmessungsnahes Giessen von rostfreiem Stahlband", Metall 53 Jahrgang, Nr. 6/99, pp. 316.

"Grundlagenuntersuchungen zum Zweirollen–Giessverfahren am Max—Planck—Institut für Eisenforschung", Aug. 18, 1997, Stahl und Eisen 117, 1997, Nr. 8, pp. 47–56.

"Entwicklungsstand des direkten Giessens von Band auf der industriellen Pilotanlage Myosotis", May 20, 1997, Stahl und Eisen 117, 1997, Nr. 5, pp. 75–79.

* cited by examiner

*Primary Examiner*—Kuang Y. Lin
(74) *Attorney, Agent, or Firm*—Collard & Roe, P.C.

(57) ABSTRACT

A thin-strip casting device (1) assures across the entire selected range of the width an about constant production of thin-strip (12) without requiring artificially extended charging times of the steel plant installed upstream. A multitude of interchangeable pairs of casting rollers (2) having different casting roller diameters "D" depending on the strip width "B" to be cast, are associated with the thin-strip casting device (1).

10 Claims, 3 Drawing Sheets

THIN-STRIP CASTING DEVICE

BACKGROUND

The invention relates to a thin-strip casting device comprised of a pair of casting rollers that oppose each other and are approximately identical. The casting rollers form a funnel by means of lateral seals for receiving the steel melt.

Thin-strip casting devices, in particular two-roller casting devices for producing hot-rolled wide strip material in the usual width range of about 800 to 1400 mm and a thickness range of about 2 to 5 mm normally found in such a production, are known in practical life. Casting rollers with a constant diameter and variable lengths of their shells are normally employed because the width of the strip material is substantially determined by the length of the shell of the casting rollers.

However, in the planning of a steel plant in the form of a mini-foundry with an annual production capacity of about 400,000 to 500,000 tons, which is installed upstream of the thin-strip casting plant and continuously supplies the latter with steel melt, the production of the steel foundry is practically constant. Therefore, the steel plant is operating economically only if at least three to five charges are poured as "conti-conti" casts. This means that the steel foundry has to be planned and designed in such a way that it is capable of supplying the thin-strip casting device with steel melt in a continuous manner when the maximum strip width is desired. However, it must also be accepted in the case where the steel foundry is operated with artificially prolonged charging times when small strip widths have to be produced. This fact, however, impairs the economy of the production facility as a whole.

SUMMARY OF THE INVENTION

The object of the invention is to increase the capacity of existing thin-strip casting devices that are already operating within their limit ranges, with low technical expenditure in terms of machinery and with justifiable investment expenditure. The objective is to avoid the drawbacks of the prior art described above to the extent that a thin-strip casting device is provided that assures an about constant production of thin-strip material over the entire selected width range, without requiring artificially prolonged charging times of the steel foundry installed upstream.

The problem is solved by a multitude of pairs of interchangeable casting rollers associated with the thin-strip casting device. These casting rollers have different casting roll diameters depending on the strip widths to be cast.

In an advantageous embodiment of the invention, each pair of casting rollers has a shell length defined by the strip width. A defined casting roll diameter is chosen whereby the product of the shell length and the casting roller diameter "D" of the casting rollers of all interchangeable pairs of casting rollers is approximately the same.

According to a useful further development of the invention, the pairs of casting rollers each are pre-installed in a changing frame.

Compared to known devices, the proposed thin-strip casting device offers a substantial advantage in that it assures without much technical expenditure a constant production of thin-strip material in any customary width range and thus an economical operation of the steel foundry operating upstream.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DESCRIPTION

Figure 1A:
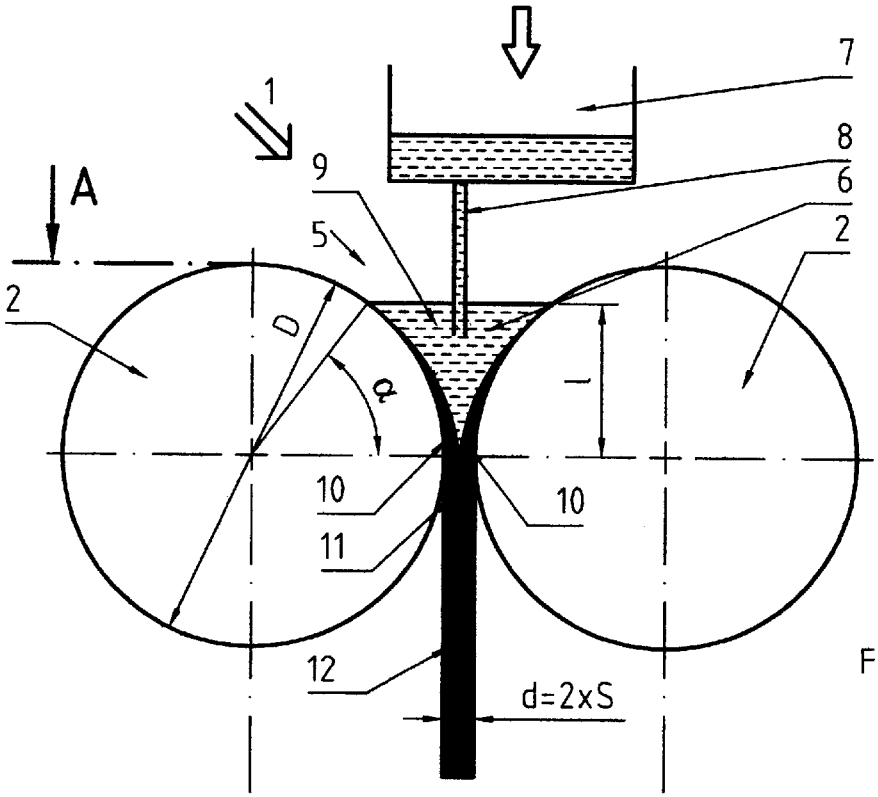
FIG. 1*a* is a side view of a thin-strip casting device in the form of a two-roller casting plant.
Figure 1B:
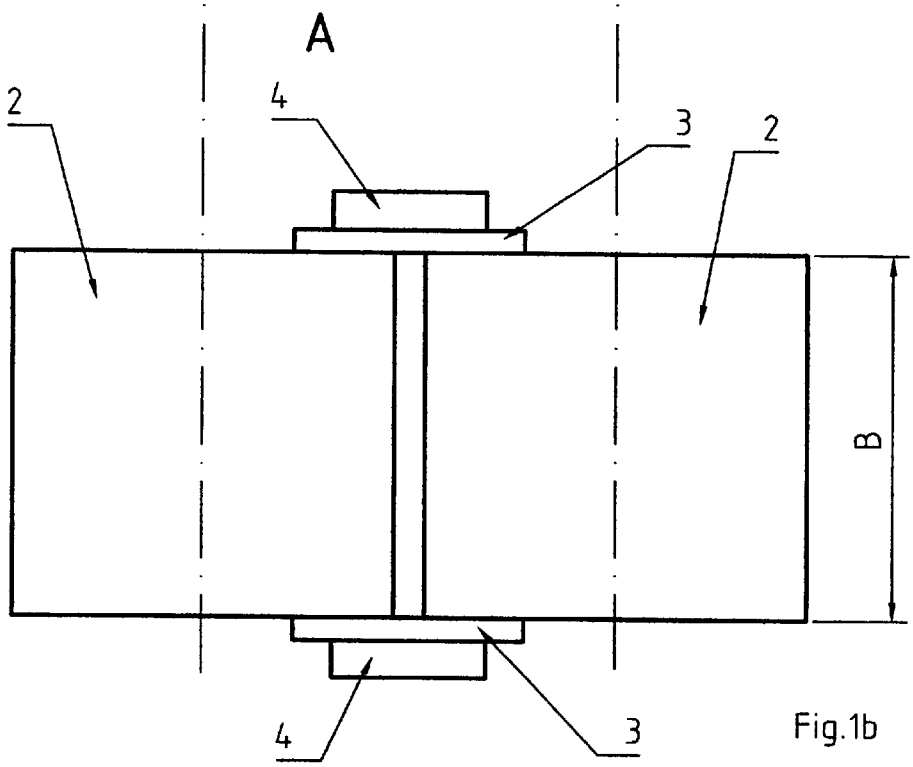
FIG. 1*b* is the view "A" according to FIG. 1*a*.

FIGS. 1*a* and 1*b* show a thin-strip casting device 1 in the form of a two-roller casting device. Casting device 1 is comprised of a pair of casting rollers 2, which oppose each other and are approximately identical. Casting rollers 2 are provided with a defined, predetermined shell length, which approximately conforms to the strip width "B" and with a defined, predetermined casting roller diameter "D".

Casting rollers 2 form a funnel 5 by means of the associated side seals 3, which each are arranged in mounting supports 4. Funnel 5 serves for receiving steel melt 6, which is continuously supplied via an intermediate container 7 equipped with an immersion tube 8, by a steel foundry that is located upstream and not shown in detail. Steel melt 6 is filled into funnel 5, formed by casting rollers 2 and side seals 3 up to a defined bath level 9. The height of bath level 9 is also referred to as a solidification length "l" and defined by a bath level angle "α".

As casting rollers 2 are rotating, preferably in mutually opposite directions, steel melt 6 solidifies on said rollers, forming two strand skins 10 or shells with a thickness "s". Due to the rotation of casting rollers 2, two strand skins 10 are moved downwards and compressed at a kiss point 11 or nip to form a thin-strip 12 with the strip thickness d=2*s. The casting rollers are preferably cooled.

Thin-strip 12 exits from thin-strip casting device 1 at the casting rate "v", which corresponds to the peripheral speed of casting rollers 2.

Furthermore, the following conditions have to be noted for thin-strip casting:

Thickness "s" of two strand skins 10 approximately results from the following known relation:

$$s=k*t^n,$$

whereby "k" is a constant depending on the cooling conditions, and "$t^n$" is the solidification time.

A value of from 0.5 to 1.0 can be assumed for "n", whereby n=0.5 applies to a constant surface temperature (conventional continuous casting), and n=1.0 applies to a constant temperature gradient in strand skin 10, thus to a highly decreasing surface temperature of said skin.

A highly decreasing surface temperature of strand skin 10 is expected in thin-strip casting, and it has been found that in the thickness range of up to about 5 mm, n=1 applies at least by approximation, and thus s=k*t applies accordingly.

Furthermore, after evaluating extensive tests and the trade literature it was found that for thin-strip casting in the thickness range of up to 5 mm, with "t" in seconds and "s" in mm, the constant for the very rapid initial solidification of strand skins 10 comes to "k"=2.5. Accordingly, the following conditions now apply:

$$s=2.5*t$$

$$d=2*s, \text{ and accordingly}$$

$$d=5*t, \text{ or } t=d/5.$$

It is known that the following applies to the casting rate "v": v=l/t, whereby solidification length l results in the following at a bath level angle "α" of 45°:

$$l=(\pi*D*45)/360=0.39*D.$$

With t=d/5, the following is obtained for "v" in m/s ("D" in m and "d" in mm):

$$v=(0.39*D*5)/d=(1.95*D)/d,$$

and accordingly the following is obtained for "v" in dm/s as well as "D" and "d" in dm:

$$v=(1.95*D)/(d*100).$$

As demonstrated above, casting rate "v" of thin-strip casting device 1 is proportional to diameter "D" of casting rollers 2 and inversely proportional to strip thickness "d".

The production "P" of thin-strip casting device 1, measured in kg/s, is obtained in dependence of strip width "B" and strip thickness "d"(each in dm), casting rate "v" (in dm/s) and the density for steel of 7.8 kg/dm$^3$ from the following relation:

$$P=B*d*v*7.8.$$

Furthermore, taking into account the above conditions with respect to "v", the following is obtained for production "P":

$$P=B*1.95*D*0.078.$$

Furthermore, it was found that the production of thin-strip casting device 1 is proportional to strip width "B" and diameter "D" of casting rollers 2.

Now, based on the evaluation of the conditions specified above, an approximately constant production "P" that is coordinated with a steel foundry located upstream, can be achieved according to the invention by associating with thin-strip casting device 1 a multitude of interchangeable pairs of casting rollers 2, whereby pairs of casting rollers 2 each have a different casting roller diameter "D" depending on band widths "B" to be cast.

Figure 2A:
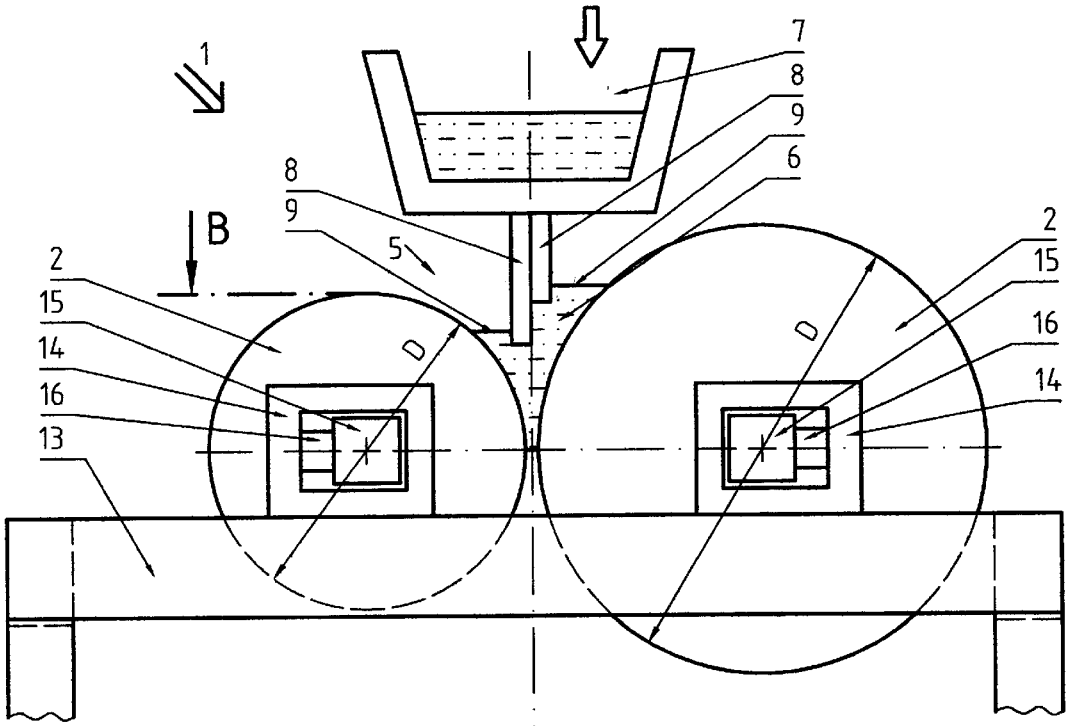
FIG. 2*a* shows the thin-strip casting device according to FIG. 1*a* in two schematically indicated variations, using differently designed casting rollers.
Figure 2B:
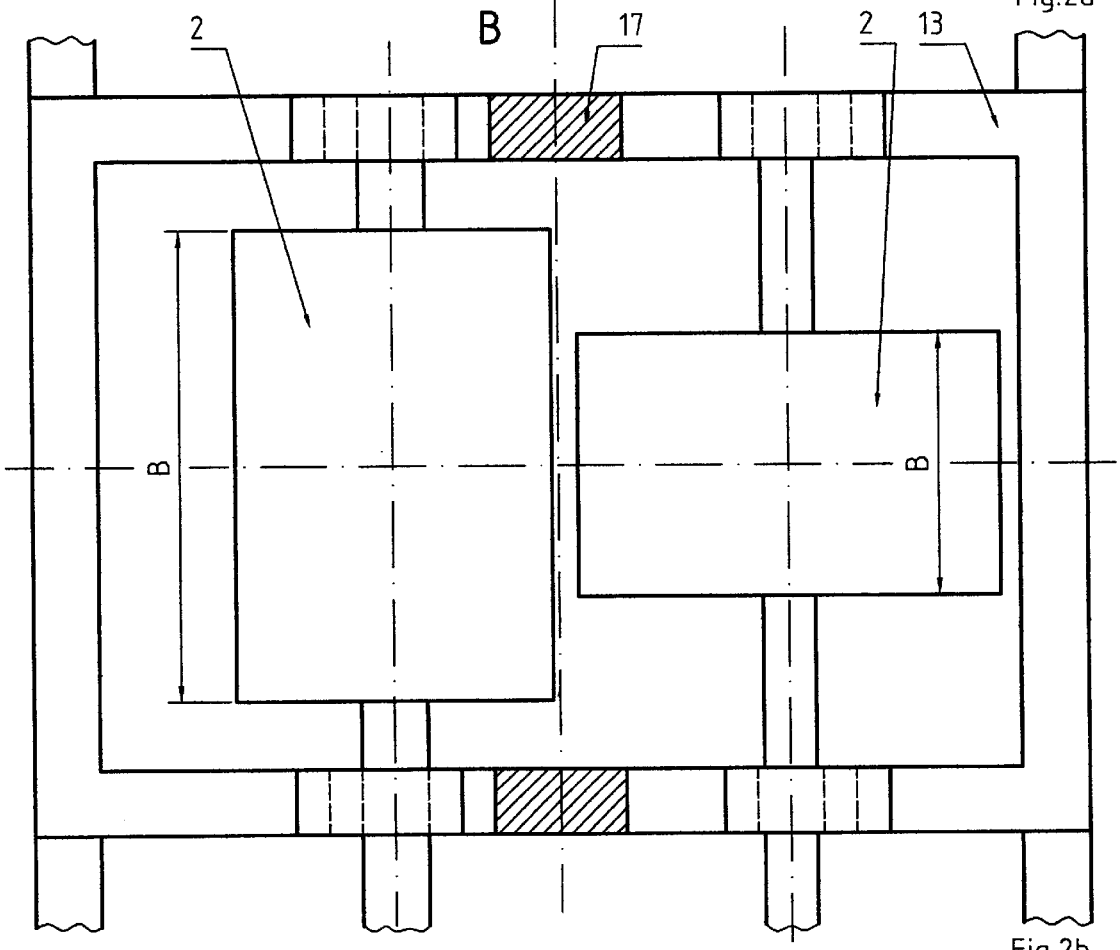
FIG. 2*b* is the view "B" according to FIG. 2*a*.

FIGS. 2*a* and 2*b* show a comparison of a side view and a top view on the left side casting roller 2 of a pair of casting rollers 2 for producing a wide thin-strip 12, and on the right side casting roller 2 of a pair of casting rollers 2 for producing a narrow thin-strip 12, because the length of the shell of casting rollers 2 is known to be defined or determined by selected strip width "B". Furthermore, casting roller 2 drawn on the left side for the wide thin-strip 12 has a smaller casting roller diameter "D" than casting roller 2 drawn on the right side.

The invention assures an approximately constant production of thin-strip 12 over the entire range selected for the width without requiring any artificially extended charging times of the steel foundry located upstream. Strip width "B" or jacket length, and casting roller diameter "D" of each pair of casting rollers 2 are selected in such a manner that the product of the jacket length and casting roller diameter "D" of all interchangeable pairs of casting rollers 2 is approximately the same.

The invention is explained by way of example in even greater detail in the following.

For a mini-foundry comprising an electric steel plant and thin-strip casting device 1 for producing hot-rolled strip material with an annual production capacity of about 500,000 tons in the width range from 800 to 1400 mm strip width "B", provision has to be made in the prior art for a steel foundry with an hourly production capacity of about 90 tons, and thin-strip casting device 1 with a casting roller diameter "D" of about 1.2 m. Based on a selected strip width "B" of 1,400 mm and the casting roller diameter "D" of 1.2 m specified above, the thin-strip casting device has an hourly production output of 90 tons as well.

However, for strip widths of less than 1,400 mm, the hourly production output of thin-strip casting device 1 is lower, so that the steel foundry, as explained above, has to be operated for the required continued continual supply of thin-strip casting device 1 with artificial pauses between the charges. With such a plant design, the annual production capacity then ensuing from the mean hourly capacity of thin-strip casting device 1 comes to between about 52 tons at 800 mm strip width, and, as specified above, to about 90 tons at 1,400 mm strip width "B".

With the measures as defined by the invention, which is to substantially employ different casting roller diameters "D" for different strip widths "B", a mini-foundry can be planned, for example for about 500,000 tons annual production capacity and strip widths "B" to be produced in the range of from 800 to 1,400 mm. The electric steel plant outputs about 70 tons hourly and thin-strip casting device 1 has casting roller diameters "D" selected, for example with 1.4 m for strip widths "B" of 800 to 1,000 mm; 1.2 m for strip widths "B" of from 1,000 to 1,200 mm; and 1.0 m for strip width "B" of from 1,200 to 1,400 mm. With such a design, the hourly production capacity of thin-strip casting device 1 is adapted over the entire width range to the hourly production output of the steel plant.

Artificial pause times of the steel plant between the individual charges are now no longer required in order to assure a continuous production "P".

FIGS. 2*a* and 2*b* furthermore show that for the purpose of a more practical handling of the pairs of casting rollers 2, i.e. for their interchange depending on the selected strip width "B" to be cast, pairs of casting rollers 2 each may be pre-installed in a change frame 13 that is mounted in a fixed, but detachable manner on a base frame—not shown in greater detail—of thin-strip casting device 1. Change frame 13, furthermore, may have the same outside dimensions for all dimensions used for casting rollers 2 employed (FIG. 2*b*).

Furthermore, change frame 13 supports setting frames 14—which are known per se—for bearings 15 of the casting rollers 2. Setting frames 14 can be set to desired strip thickness "d", for example by means of the hydraulically or pneumatically actuated setting cylinders 16.

Figure 3:
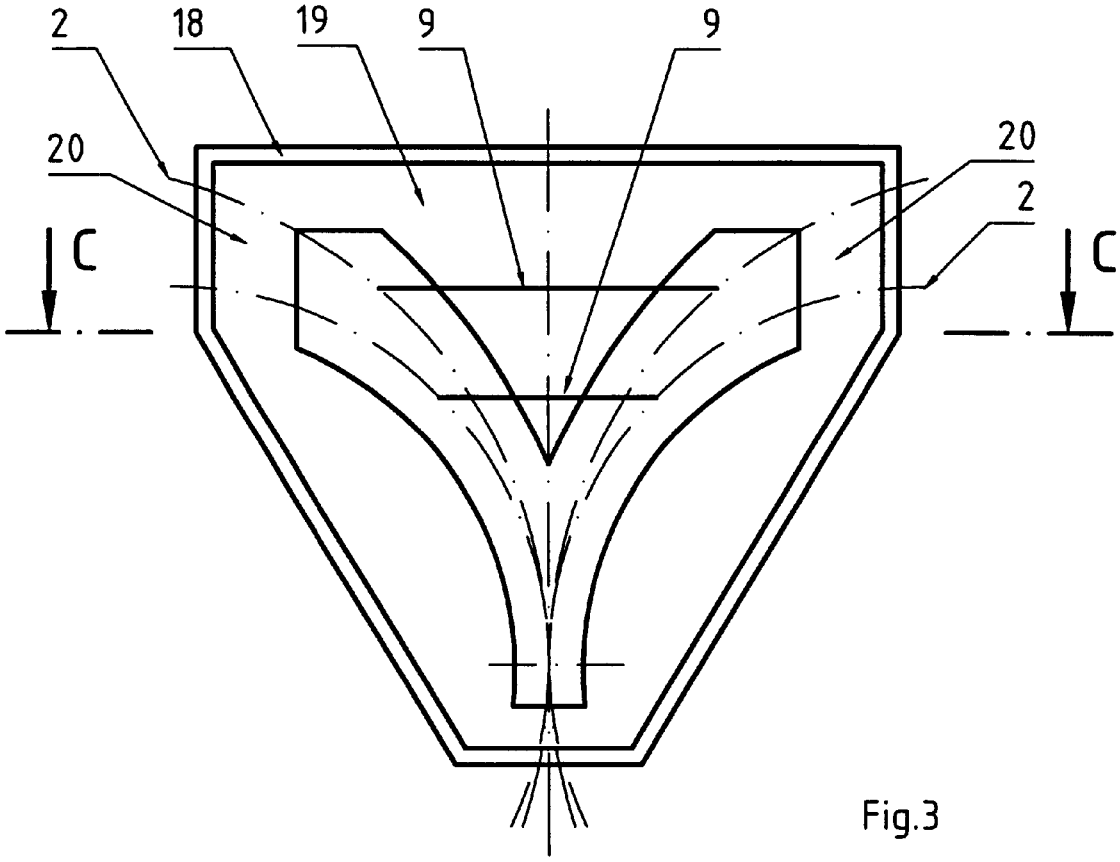
FIG. 3 is the side view of a side seal for a pair of casting rollers.
Figure 4:
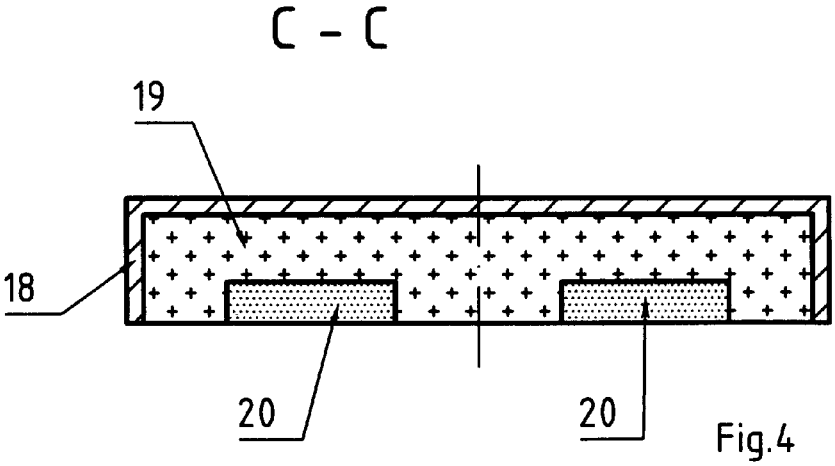
FIG. 4 shows the section C-C according to FIG. 3.

Holding elements 4 for the side seals 3—which are known per se and not shown in greater detail in FIGS. 2*a* and 2*b*—of pairs of casting rollers 2 are mounted on support surfaces 17 of change frame 13. Lateral seals 3 are known to be substantially formed by outer frame 18 that is lined with a cast refractory compound 19 (FIGS. 3 and 4). On both sides of casting rollers 2, insert 20 consisting of a special ceramic material, for example boron nitride, is embedded on each side in refractory compound 19. Inserts 20 envelop the peripheral tracks of casting rollers 2 disposed below bath level 9.

Suitably adapted lateral seals 3 may be associated with the different diameters "D" of the casting rollers. Furthermore, it is possible also to design lateral seals 3 in such a manner that the same lateral seals 3 may be associated with pairs of casting rollers 2 having the different casting roller diameters "D", by designing, for example inserts 20 in a variable manner in the zone of the peripheral surfaces of casting rollers 2, such inserts enveloping the latter.

The same may apply to holding elements 4 of lateral seals 3, which may be adaptable to changed casting roller diameters "D" and, if need be, to variably designed lateral seals 3, as well as to changed shell lengths of casting rollers 2, by adjustably and lockably guiding said holding elements vertically and/or horizontally and/or radially in guide elements such as, for example rails, which are not shown in detail, but known per se.

As far as change frame 13 is concerned, it is recommended to provide two change frames 13, of which the one frame is in use with a corresponding pair of casting rollers 2, and the other is being prepared with a corresponding pair of casting rollers 2 and new lateral seals 3 for the next change.

Accordingly, while at least one embodiment of the present invention has been shown and described, it is to be understood that many changes and modifications may be made thereunto without departing from the spirit and scope of the invention as defined in the appended claims.

What is claimed is:

1. A thin-strip casting device that is supplied with steel melt from a steel foundry, the thin-strip casting device Comprising:

a) a pair of rotatably supported parallel casting rollers axially spaced adjacent to each other so as to define a kiss point for receiving steel melt, wherein said casting rollers have approximately the same design, rotate in mutually opposite directions, and have a predetermined length which relates to a resulting strip width; and b) lateral seats disposed at each lateral end of said pair of casting rollers so as to form a funnel area between said pair of casting rollers and said lateral seals;

wherein at least two interchangeable pairs of casting rollers are associated with the thin-strip casting device and wherein each of said at least two interchangeable pairs of casting rollers has a shell length and a diameter defined so that the product of said shell length and said diameters of every pair of casting rollers in the thin-strip casting device is approximately the same.

2. The thin-strip casting device according to claim 1 further comprising:

a. a holding element disposed on the outer end of each lateral seal, wherein said holding element holds the lateral seal in the thin-strip casting device;

b. at least one bearing element that runs through each casting roller, wherein said at least one bearing element allows said casting roller to rotate around it;

c. setting frames in which the ends of said at least one bearing element are installed; and d. a change frame in which said pair of casting rollers are situated and upon which said holding element and said setting frames are installed.

3. The thin-strip casting device according to claim 2 wherein said setting frames are set to create a desired strip thickness by means of a hydraulically activated setting cylinder, wherein said cylinder is disposed in said setting frame and said cylinder moves said at least one pair of casting rollers closer together or further apart.

4. The thin-strip casting device according to claim 2, wherein said setting frames are set to create a desired strip thickness by means of a pneumatically activated setting cylinder, wherein said cylinder is disposed in said setting frame and said cylinder moves said at least one pair of casting rollers closer together or further apart.

5. The thin-strip casting device according to claim 2, wherein said holding elements are mounted on support surfaces of said change frame.

6. The thin-strip casting device according to claim 1, wherein said lateral seals comprise:

a. an outer frame that surrounds said lateral seal that is lined with a cast refractor compound; and b. an insert disposed on the inside of said lateral seal made of a ceramic material that envelopes the track of said casting roller below said bath height.

7. The thin-strip casting device according to claim 2, wherein said lateral seals are adaptable to casting rollers with different diameters by having a wider space in said inserts at the peripheral surface of said casting rollers to envelope said casting rollers.

8. The thin-strip casting device according to claim 7, wherein said lateral seals are adaptable to casting rollers of different diameters by adjustably guiding said holding elements on guide elements to meet different shell lengths.

9. The thin-strip casting device according to claim 2, wherein two change frames are used so that while one change frame is in use the other is prepared with a pair of casting rollers and lateral seals for the production of the next thin-strip.

10. The thin-strip casting device according to claim 1, wherein said at least one pair of casting rollers are cooled.

* * * * *